US009259953B2

(12) United States Patent
Tyagi et al.

(10) Patent No.: US 9,259,953 B2
(45) Date of Patent: Feb. 16, 2016

(54) TACTILE IMAGES HAVING COEFFICIENT OF FRICTION DIFFERENCES

(71) Applicants: Dinesh Tyagi, Fairport, NY (US); Louise Granica, Victor, NY (US)

(72) Inventors: Dinesh Tyagi, Fairport, NY (US); Louise Granica, Victor, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 78 days.

(21) Appl. No.: 14/038,820

(22) Filed: Sep. 27, 2013

(65) Prior Publication Data

US 2015/0093149 A1 Apr. 2, 2015

(51) Int. Cl.
*G03G 15/00* (2006.01)
*B41M 3/16* (2006.01)

(52) U.S. Cl.
CPC ..... *B41M 3/16* (2013.01)

(58) Field of Classification Search
CPC ..... G03G 15/224
USPC ..... 399/130
See application file for complete search history.

(56) References Cited

U.S. PATENT DOCUMENTS

| | | | |
|---|---|---|---|
| 3,694,359 | A | 9/1972 | Merrill |
| 3,893,935 | A | 7/1975 | Jadwin et al. |
| 4,073,070 | A | 2/1978 | Boston |
| 4,079,014 | A | 3/1978 | Burness et al. |
| 4,089,472 | A | 5/1978 | Siegel et al. |
| 4,160,644 | A | 7/1979 | Ryan |
| 4,220,675 | A | 9/1980 | Imazaki |
| 4,323,634 | A | 4/1982 | Jadwin |
| 4,338,390 | A | 7/1982 | Lu |
| RE31,072 | E | 11/1982 | Jadwin et al. |
| 4,394,430 | A | 7/1983 | Jadwin et al. |
| 4,414,152 | A | 11/1983 | Santilli et al. |
| 4,416,965 | A | 11/1983 | Sandhu et al. |
| 4,430,408 | A | 2/1984 | Sitaramiah |
| 4,624,907 | A | 11/1986 | Niimura et al. |
| 4,780,553 | A | 10/1988 | Suzuki et al. |
| 4,814,250 | A | 3/1989 | Kwarta et al. |
| 4,834,920 | A | 5/1989 | Bugner et al. |
| 4,840,864 | A | 6/1989 | Bugner et al. |
| 4,972,501 | A | 11/1990 | Horyu |
| 5,120,631 | A | 6/1992 | Kanbayashi et al. |
| 5,125,996 | A | 6/1992 | Campbell et al. |
| 5,180,650 | A | 1/1993 | Sacripante et al. |
| 5,298,356 | A | 3/1994 | Tyagi et al. |
| 5,714,295 | A | 2/1998 | Wilson et al. |
| 5,910,388 | A | 6/1999 | Ray et al. |
| 6,342,273 | B1 | 1/2002 | Handels et al. |
| 6,608,641 | B1 | 8/2003 | Alexandrovich |
| 6,728,503 | B2 | 4/2004 | Stelter et al. |

(Continued)

*Primary Examiner* — Quana M Grainger
(74) *Attorney, Agent, or Firm* — Kevin E. Spaulding

(57) ABSTRACT

A method for forming a tactile printed image on a receiver medium to convey information to a visually-impaired person from image data having an array image pixels with binary pixel values. The tactile printed image by depositing tactile marking material onto the receiver medium, wherein no tactile marking material is deposited onto portions of the receiver medium corresponding to image pixels having a first state, and tactile marking material is deposited onto portions of the receiver medium corresponding to image pixels having the second state. The receiver medium has a first coefficient of friction, and the portions of the tactile printed image having deposited tactile marking material are raised by at least 20 microns relative to the surface of the receiver medium and have a second coefficient of friction which differs from the first coefficient of friction by at least 0.06.

16 Claims, 5 Drawing Sheets

(56) References Cited

U.S. PATENT DOCUMENTS

| | | | | |
|---|---|---|---|---|
| 6,755,350 | B2 | 6/2004 | Rochford et al. | |
| 7,014,910 | B2 * | 3/2006 | Rochford et al. | 428/195.1 |
| 7,120,379 | B2 | 10/2006 | Eck et al. | |
| 7,139,521 | B2 | 11/2006 | Ng et al. | |
| 7,290,951 | B2 | 11/2007 | Tanaka et al. | |
| 7,326,507 | B2 | 2/2008 | Schulze-Hagenest et al. | |
| 7,955,772 | B2 | 6/2011 | Schuster et al. | |
| 8,064,788 | B2 | 11/2011 | Zaretsky et al. | |
| 8,147,948 | B1 | 4/2012 | Tyagi et al. | |
| 8,328,343 | B2 * | 12/2012 | Aruga et al. | 347/100 |
| 8,404,424 | B2 * | 3/2013 | Schulze-Hagenest et al. | 430/123.4 |
| 2002/0003469 | A1 | 1/2002 | Gupta | |
| 2003/0087176 | A1 | 5/2003 | Ezenyilimba et al. | |
| 2006/0133870 | A1 | 6/2006 | Ng et al. | |
| 2006/0135670 | A1 | 6/2006 | Richter et al. | |
| 2008/0159786 | A1 | 7/2008 | Tombs et al. | |
| 2009/0291213 | A1 * | 11/2009 | Ohshima et al. | 427/256 |
| 2010/0164218 | A1 | 7/2010 | Schulze-Hagenest et al. | |
| 2010/0232821 | A1 * | 9/2010 | Zaretsky et al. | 399/67 |
| 2011/0160389 | A1 | 6/2011 | Babat et al. | |
| 2011/0200360 | A1 | 8/2011 | Tyagi et al. | |
| 2011/0200932 | A1 | 8/2011 | Tyagi et al. | |
| 2011/0200933 | A1 | 8/2011 | Tyagi et al. | |
| 2011/0236698 | A1 | 9/2011 | Filou et al. | |
| 2011/0262654 | A1 | 10/2011 | Yates et al. | |
| 2011/0262858 | A1 | 10/2011 | Nair et al. | |
| 2012/0202021 | A1 | 8/2012 | Schulze-Hagenest et al. | |

* cited by examiner

TACTILE IMAGES HAVING COEFFICIENT OF FRICTION DIFFERENCES

CROSS-REFERENCE TO RELATED APPLICATIONS

Reference is made to commonly assigned, co-pending U.S. patent application Ser. No. 13/461,875, entitled "Printed image for visually-impaired person," by Delmerico; to commonly assigned, co-pending U.S. patent application Ser. No. 13/591,256, entitled "Electrographic printing of tactile images," by Rimai et al.; and to commonly assigned, co-pending U.S. patent application Ser. No. 13/591,259, entitled "Electrographic tactile image printing system," by Rimai et al., each of which is incorporated herein by reference.

FIELD OF THE INVENTION

This invention pertains to the field of electrographic printing and more particularly to a method of forming tactile images.

BACKGROUND OF THE INVENTION

Electrophotography is a useful process for printing images on a receiver (or "imaging substrate"), such as a piece or sheet of paper or another planar medium (e.g., glass, fabric, metal, or other objects) as will be described below. In this process, an electrostatic latent image is formed on a photoreceptor by uniformly charging the photoreceptor and then discharging selected areas of the uniform charge to yield an electrostatic charge pattern corresponding to the desired image (i.e., a "latent image").

After the latent image is formed, charged toner particles are brought into the vicinity of the photoreceptor and are attracted to the latent image to develop the latent image into a toner image. Note that the toner image may not be visible to the naked eye depending on the composition of the toner particles. For example, colorless toner can be used to form a substantially clear image.

After the latent image is developed into a toner image on the photoreceptor, a suitable receiver is brought into juxtaposition with the toner image. A suitable electric field is applied to transfer the toner particles of the toner image to the receiver to form the desired print image on the receiver. The imaging process is typically repeated many times with reusable photoreceptors.

The receiver is then removed from its operative association with the photoreceptor and subjected to heat or pressure to permanently fix (i.e., "fuse") the print image to the receiver. Plural print images (e.g., separation images of different colors) can be overlaid on the receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (y) direction of a portrait-oriented receiver. The direction perpendicular to the slow-scan direction is referred to as the fast-scan, cross-process, or cross-track direction, and is typically the horizontal (x) direction of a portrait-oriented receiver. "Scan" does not imply that any components are moving or scanning across the receiver; the terminology is conventional in the art.

The magnitude of the charge on the toner particles is of vital importance in electrophotography and generally limits both the amount of toner deposited in an area and the size of the toner particles. This is discussed in commonly-assigned U.S. Pat. No. 8,147,948 to Tyagi et al., entitled "Printed article," which is incorporated herein by reference. Specifically, the amount of toner deposited to convert the electrostatic latent image on the photoreceptor is proportional to the difference of potential between a development station that is used to transport the electrically charged toner particles into operative proximity to the latent image bearing photoreceptor and the photoreceptor. The photoreceptor is initially charged to a potential using known means such as a corona or roller charger and an electrostatic latent image is formed on the photoreceptor by image-wise exposing, thus discharging the photoreceptor in an image-wise fashion. The initial potential is limited by the dielectric strength of the photoreceptor. For a typical organic photoreceptor commonly used today, the initial potential is limited to less than approximately 500 V. The potential on the development station is limited by the necessity of not depositing toner particles in un-toned areas. Thus, the magnitude of the minimum difference of potential must be sufficient to preferentially attract the charge toner particles towards the development station in regions where toner particles should not be deposited on the photoreceptor.

After development of the electrostatic latent image to convert the electrostatic latent image into the toner image, the toner image is transferred from the photoreceptor to a receiver such as paper. Transfer is generally accomplished by transporting the toner image-bearing photoreceptor into contact with a receiver and subjecting the photoreceptor-receiver to an electrostatic field and pressure that urges the toner particles to transfer from the photoreceptor to the receiver. Countering the applied electrostatic forces resulting from the applied electrostatic field are electrostatic forces between the charged toner particles and the photoreceptor and surface forces such as those arising from van der Waals interactions that adhere the toner particles to the photoreceptor. The applied electrostatic force must be sufficient to overcome the forces that hold the toner to the photoreceptor in order for the toner particles to be transferred to the receiver.

The applied electrostatic force exerted on a toner particle is the product of the charge on the toner particle times the applied electrostatic transfer field. Increasing the charge on a toner particle increases the adhesion of that particle to the photoreceptor. Moreover, the field generated by the charged toner particles counters and reduces the applied electrostatic transfer field. Thus, increasing toner charge decreases the force available to transfer the toner particles from the photoreceptor to the receiver. This makes transfer more difficult. In addition, increasing toner charge also limits the amount of toner that is deposited during the development process when the electrostatic latent image is converted into a visible image. It is obvious that the amount of charge that can be imparted onto a toner particle is necessarily limited.

The magnitude of the electrostatic transfer field is limited by the Paschen discharge limit of air. Air can support a maximum applied field, known as the Paschen limit. The Paschen limit decreases with increasing air gap. For a 10 μm air gap, the limit is approximately 35 V/μm. As the size of the gap increases, as would occur when making raised letter printing or other applications that require the formation of macroscopic toner structures such as Braille, textured effects, etc. the size of the electrostatic transfer field that can be applied decreases as the size of the relief pattern generated to provide the raised lettering or macroscopic toner structures increases. Moreover, the presence of macroscopic relief structures generally requires the presence of large quantities of electrically charged toner particles. The charge on the toner particles generates an electrostatic field that subtracts from the applied field in the presence of the toner structure while the air gap in the vicinity around the relief structure limits the size of the applied field due to the Paschen discharge limit. Accordingly, it is often not possible to electrostatically transfer macroscopic toner structures generated when forming macroscopic toner structures from the photoreceptor to a receiver. It is clear that a new method of forming macroscopic toner relief patterns is necessary.

There remains a need for an improved method for producing printed images that can be sensed using tactile means.

SUMMARY OF THE INVENTION

The present invention represents a method for forming a tactile printed image on a receiver medium to convey information to a visually-impaired person, comprising:

receiving tactile image data having an array of image pixels with tactile pixel values, the tactile image data defining a pattern of tactile features; and forming the tactile printed image by depositing tactile marking material onto the receiver medium, wherein no tactile marking material is deposited onto portions of the receiver medium where the corresponding tactile pixel values indicate that no tactile features are to be formed, and wherein tactile marking material is deposited onto portions of the receiver medium where the corresponding tactile pixel values indicate that tactile features are to be formed;

wherein the receiver medium has a first coefficient of friction and the portions of the tactile printed image having deposited tactile marking material have a second coefficient of friction which differs from the first coefficient of friction by at least 0.06, and wherein the portions of the tactile printed image having deposited tactile marking material are raised by at least 20 microns relative to the surface of the receiver medium.

This invention has the advantage that it provides an increased tactile feel for tactile features in a document without increasing the height of the printed tactile features on the document.

It has the additional advantage that it provides an increased tactile feel without incurring the fusing difficulties associated with increased toner mass.

It has the further advantage that tactile features can be more easily printed on both sides of the document.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
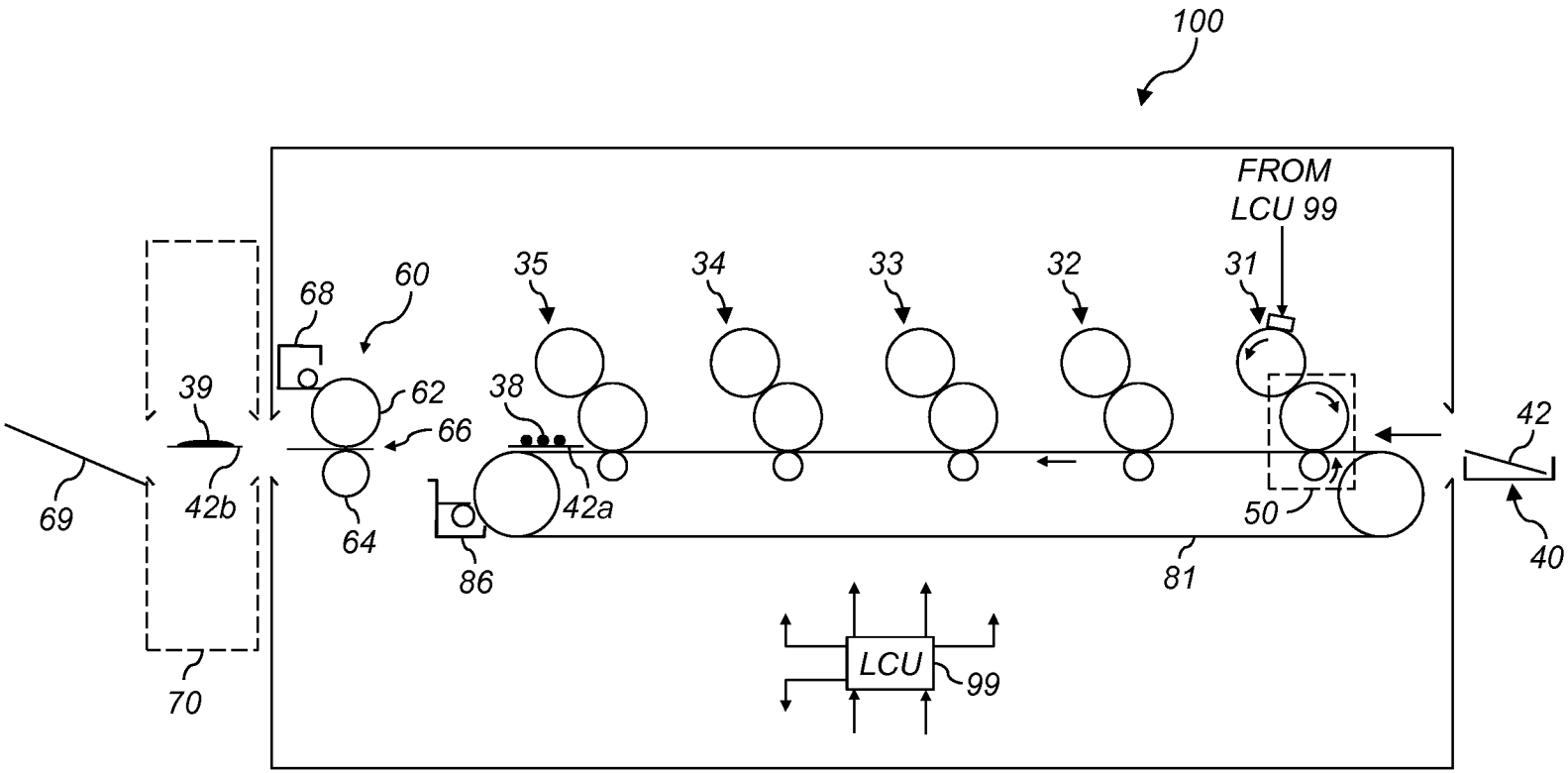
FIG. 1 is an elevational cross-section of an electrophotographic printer suitable for use with various embodiments.

The attached drawings are for purposes of illustration and are not necessarily to scale.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

As used herein to define various components of toner particles, polymers, oxide particles, colorants, and other substances, unless otherwise indicated, the singular forms "a," "an," and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about." In this manner, slight variations above and below the stated ranges can be used to achieve substantially the same results as the values within the ranges. In addition, the disclosure of these ranges is intended as a continuous range including every value between and including the minimum and maximum values.

The terms "particle size," "size," and "sized" as used herein in reference to toner particles including the dry toner particles of this invention, is defined in terms of the mean volume weighted diameter ($D_{vol}$) in μm as measured by conventional diameter measuring devices such as a Coulter Multisizer (Coulter, Inc.). The mean volume weighted diameter is the sum of the mass of each dry toner particle multiplied by the diameter of a spherical particle of equal mass and density, divided by the total dry toner particle mass.

The term "electrostatic printing process" as used herein refers to printing methods including but not limited to, electrophotography and direct, solid toner printing as described herein. As used in this invention, electrostatic printing means does not include the use or application of liquid toners to form images on receiver materials.

The term "color" as used herein refers to dry color toner particles containing one or more colorants (dyes or pigments) that provide a color or hue having an optical density of at least 0.2 at the maximum exposure so as to distinguish them from "colorless" dry toner particles that have a lower optical density. As used herein the term "color toner particles" applies to particles having a neutral color (e.g., black or gray) as well as toner particles having a non-neutral color (e.g., cyan, magenta or yellow).

The term "coefficient of friction" (COF) as used herein in reference to frictional characteristics of a surface refers to the dynamic coefficient of friction of a surface as measured against a steel block at 23° C. To measure the coefficient of friction, a known weight of stainless steel block is placed on the surface being characterized and the force required to continuously move the block is measured. The ratio of the applied force to the weight of the steel block provides the desired value. The coefficient of friction for a receiver medium is measured in an area of the receiver medium that is not covered by toner. The coefficient of friction for a toner is measured in an area of a printed image where the receiver medium is uniformly covered by toner particles that have been fused to the surface of the receiver medium.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters (e.g., less than 8 μm, on the order of 10-15 μm, up to approximately 30 μm, or larger), where "diameter" preferably refers to the volume-weighted median diameter, as determined by a device such as a Coulter Multisizer. When practicing this invention, it is preferable to use larger toner particles (i.e., toner particles having diameters between 12-30 μm, and preferably having diameters of at least 20 μm) in order to obtain the desirable toner stack heights that would enable macroscopic toner relief structures to be formed.

"Toner" refers to a material or mixture that contains toner particles, and that can be used to form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

As mentioned already, toner includes toner particles; it can also include other types of particles. The particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remanence, florescence, resistance to etchants, and other properties of additives known in the art. The toner particles could also include inorganic or organic additives that increase the coefficient of friction difference of the toner relative to the receiver medium. The coefficient of friction could be either increased or decreased with respect to the receiver medium to achieve the desired coefficient of friction separation.

In single-component or mono-component development systems, "developer" refers to toner alone. In these systems, none, some, or all of the particles in the toner can themselves be magnetic. However, developer in a mono-component system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles (e.g., 15-20 μm or 20-300 μm in diameter). A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields). The present invention can be practiced using any type of electrographic printing system, including electrophotographic and ionographic printers.

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color images onto a receiver. A printer can also produce selected patterns of toner on a receiver, which patterns (e.g., surface textures) do not correspond directly to a visible image.

The DFE receives input electronic files (such as Postscript command files) composed of images from other input devices (e.g., a scanner, a digital camera or a computer-generated image processor). Within the context of the present invention, images can include photographic renditions of scenes, as well as other types of visual content such as text or graphical elements. Images can also include invisible content such as specifications of texture, gloss or protective coating patterns.

The DFE can include various function processors, such as a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system that accounts for characteristics of the image printing process implemented in the print engine (e.g., the electrophotographic process) to provide known, consistent color reproduction characteristics. The color management system can also provide known color reproduction for different inputs (e.g., digital camera images or film images). Color management systems are well-known in the art, and any such system can be used to provide color corrections in accordance with the present invention.

In an embodiment of an electrophotographic modular printing machine useful with various embodiments (e.g., the NEXPRESS 2100 printer manufactured by Eastman Kodak Company of Rochester, N.Y.) color-toner print images are made in a plurality of color imaging modules arranged in tandem, and the print images are successively electrostatically transferred to a receiver adhered to a transport web moving through the modules. Colored toners include colorants, (e.g., dyes or pigments) which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit colorless (i.e., clear) toner using an additional imaging module are also known. The provision of a clear-toner overcoat to a color print is desirable for providing features such as protecting the print from fingerprints, reducing certain visual artifacts or providing desired texture or surface finish characteristics. Colorless toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of colorless toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss. When tactile information is to be printed on the receiver media, large toner particles (e.g., having a toner size in excess of 15 μm) are preferably deposited using the fifth imaging unit. Alternatively, more than one toner deposited on the substrate could have a large toner size.

Figure 2:
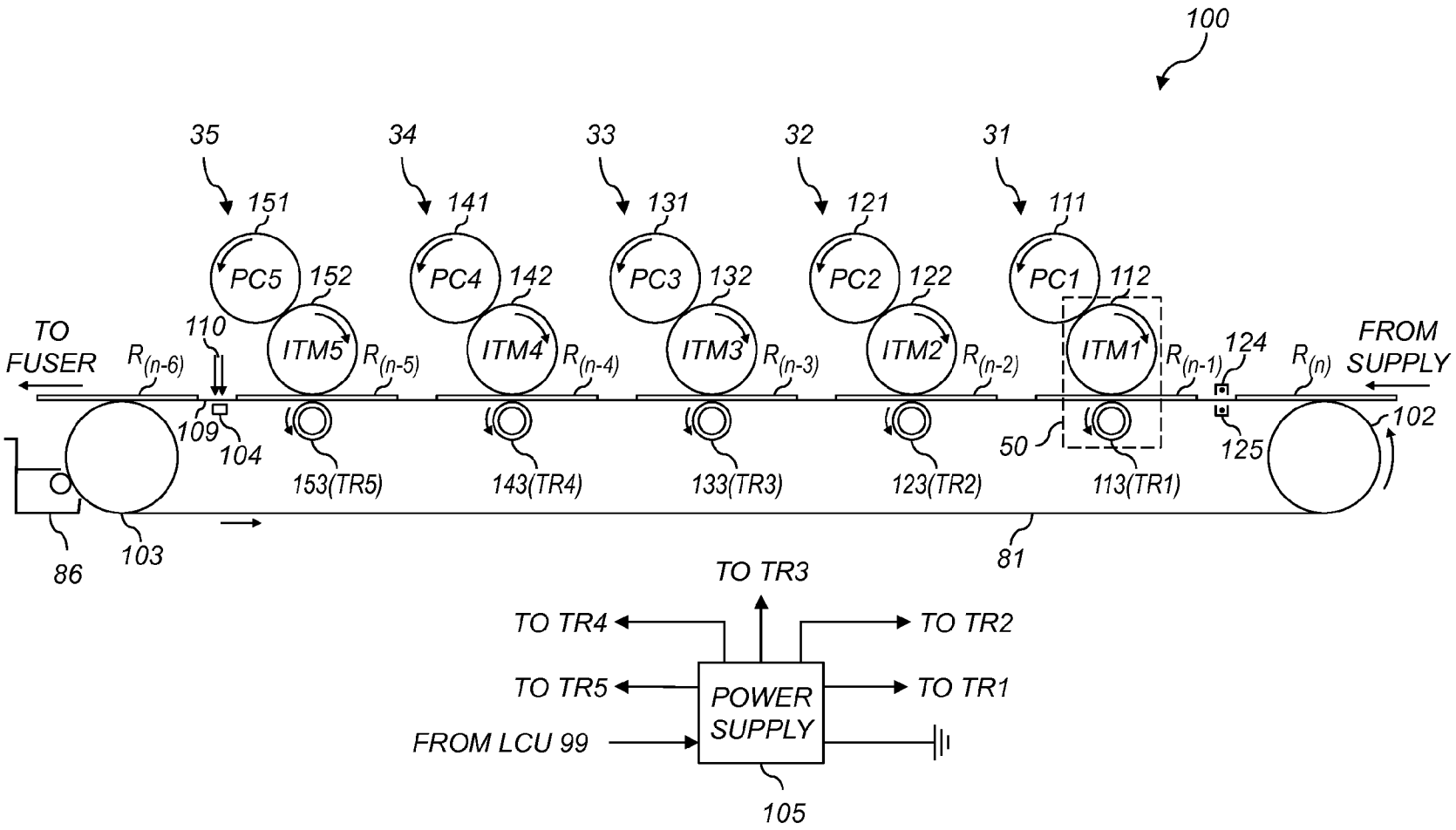
FIG. 2 is an elevational cross-section of the reprographic image-producing portion of the electrophotographic printer of FIG. 1.
Figure 3:
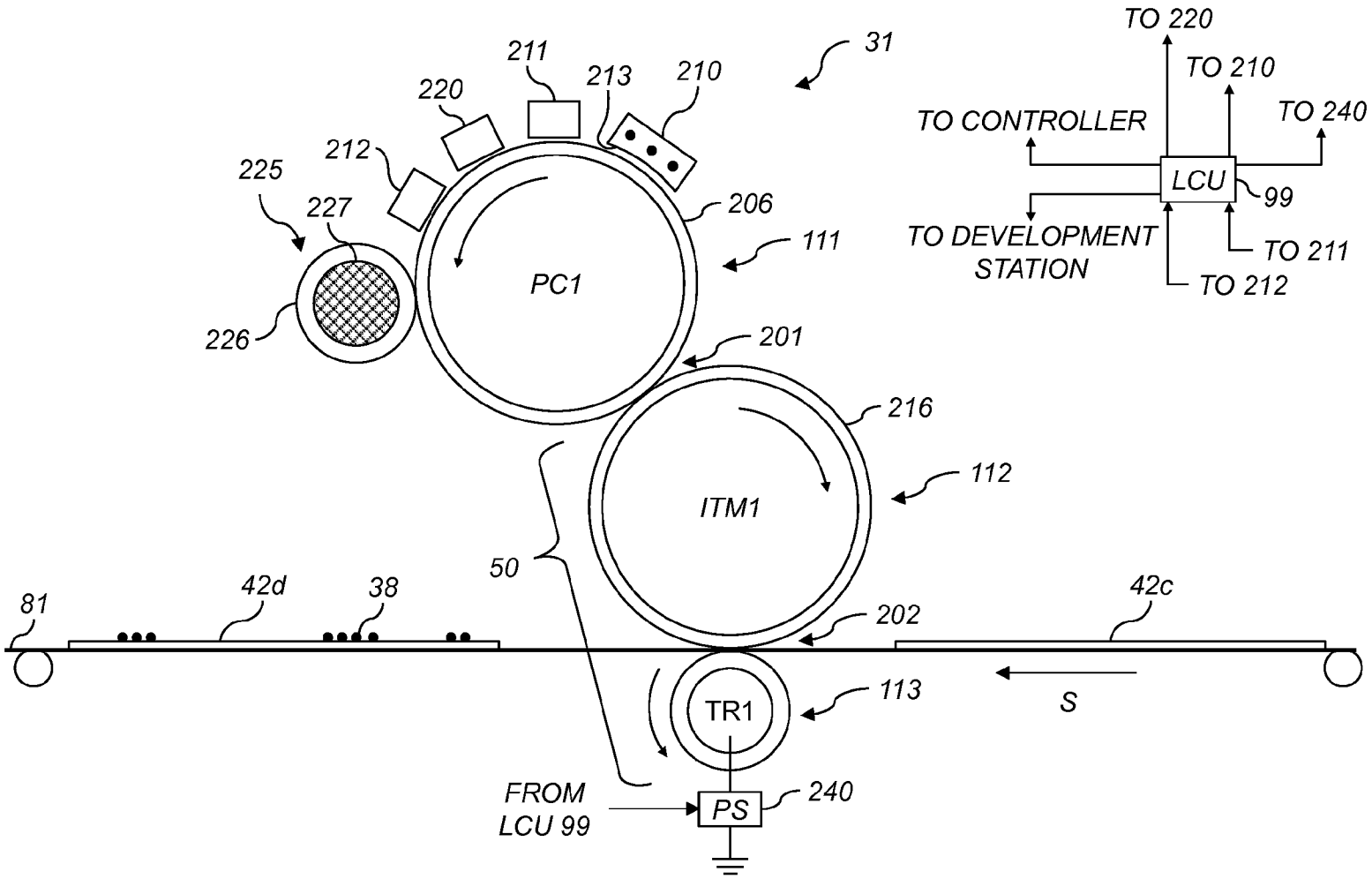
FIG. 3 is an elevational cross-section of one printing module of the electrophotographic printer of FIG. 1.

FIGS. 1-3 are elevational cross-sections showing portions of a typical electrophotographic printer 100 useful with various embodiments. Printer 100 is adapted to produce images, such as single-color images (i.e., monochrome images), or multicolor images such as CMYK, or pentachrome (five-color) images, on a receiver. Multicolor images are also known as "multi-component" images. One embodiment involves printing using an electrophotographic print engine having five sets of single-color image-producing or image-printing stations or modules arranged in tandem, but more or less than five colors can be combined on a single receiver. A tactile toner can also be used as the fifth toner in addition to the CYMK color toners. The tactile toner can be colorless to provide a clear tactile image, or alternately can be colored so that the tactile image is both visible and detectable by touch. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module 31, 32, 33, 34, 35 produces a single-color toner image for transfer using a respective transfer subsystem 50 (for clarity, only one is labeled) to a receiver media 42 successively moved through the modules. Receiver media 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and then to receiver media 42. Receiver media 42 is, for example, a selected section of a web of, or a cut sheet of, planar media such as paper or transparency film.

Each receiver media 42, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an exemplary embodiment, printing module 31 forms black (K) print images, printing module 32 forms yellow (Y) print images, printing module 33 forms magenta (M) print images, and printing module 34 forms cyan (C) print images.

Printing module 35 can form a red, blue, green, or other fifth print image, including an image formed from a colorless toner (e.g., one lacking pigment) or a tactile toner which, in accordance with the present invention, preferably comprises a formulation to affect the coefficient of friction following the fusing step. The four subtractive primary colors, cyan, magenta, yellow, and black, can be combined in various combinations of subsets thereof to form a representative spectrum of colors. The color gamut of a printer (i.e., the range of colors that can be produced by the printer) is dependent upon the materials used and the process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a colorless toner or a tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light. In accordance with a preferred embodiment of the present invention, the fifth color toner is a colorless (or colored) tactile toner adapted to provide a tactile image by providing tactile features having a coefficient of friction that is substantially different than the coefficient of friction of the receiver media 42.

Receiver media **42*a* is shown after passing through printing module 35. Print image 38 on receiver media 42*a* includes unfused toner particles. Subsequent to transfer of the respective print images, overlaid in registration, one from each of the respective printing modules 31, 32, 33, 34, 35, receiver media 42*a* is advanced to a fuser module 60 (i.e., a fusing or fixing assembly) to fuse the print image 38 to the receiver media 42***a*. Transport web 81 transports the print-image-carrying receivers to the fuser module 60, which fixes the toner particles to the respective receivers, generally by the application of heat and pressure. The receivers are serially de-tacked from transport web 81 to permit them to feed cleanly into the fuser module 60. The transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along the transport web 81 before or after cleaning station 86 in the direction of rotation of transport web 81.

Fuser module 60 includes a heated fusing roller 62 and an opposing pressure roller 64 that form a fusing nip 66 therebetween. In an embodiment, fuser module 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The fused receivers (e.g., receiver media 42*b* carrying fused image 39) are transported in series from the fuser module 60 along a path either to a remote output tray 69, or back to printing modules 31, 32, 33, 34, 35 to form an image on the backside of the receiver (i.e., to form a duplex print). Receiver media 42*b* can also be transported to any suitable output accessory. For example, an auxiliary fuser or glossing assembly can provide a clear-toner overcoat. Printer 100 can also include multiple fuser modules 60 to support applications such as overprinting, as known in the art.

In various embodiments, between the fuser module 60 and the output tray 69, receiver media 42*b* passes through a finisher 70. Finisher 70 performs various paper-handling operations, such as folding, stapling, saddle-stitching, collating, and binding.

Printer 100 includes main printer apparatus logic and control unit (LCU) 99, which receives input signals from various sensors associated with printer 100 and sends control signals to components of printer 100. LCU 99 can include a digital processor such as a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. In some embodiments, sensors associated with the fuser module 60 provide appropriate signals to the LCU 99. In response to the sensor signals, the LCU 99 issues command and control signals that adjust the heat or pressure within fusing nip 66 and other operating parameters of fuser module 60. This permits printer 100 to print on receivers of various thicknesses and surface finishes, such as glossy or matte.

Image data for printing by printer 100 can be processed by a raster image processor (RIP; not shown), which can include a color separation screen generator or generators. The output of the RIP can be stored in frame or line buffers for transmission of the color separation print data to each of a set of respective LED writers associated with the printing modules 31, 32, 33, 34, 35 (e.g., for black (K), yellow (Y), magenta (M), cyan (C), and tactile (T) color channels, respectively). The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes (e.g., color correction) in order to obtain the desired color print. Color image data is separated into the respective colors and converted by the RIP to halftone dot image data in the respective color (for example, using halftone matrices, which provide desired screen angles and screen rulings). The RIP can be a suitably-programmed computer or logic device and is adapted to employ stored or computed halftone matrices and templates for processing separated color image data into rendered image data in the form of halftone information suitable for printing. These halftone matrices can be stored in a screen pattern memory (SPM).

Referring to FIG. 2, which shows additional details of printer 100, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member 111, 121, 131, 141, 151 (PC1, PC2, PC3, PC4, PC5), such as a photoconductive roller or belt, an intermediate transfer member 112, 122, 132, 142, 152 (ITM1, ITM2, ITM3, ITM4, ITM5), e.g., a blanket roller, and transfer backup member 113, 123, 133, 143, 153 (TR1, TR2, TR3, TR4, TR5), e.g., a roller, belt or rod. Thus in printing module 31, a print image (e.g., a black separation image) is created on imaging member 111 (PC1), transferred to intermediate transfer member 112 (ITM1), and transferred again to receiver $R_{(n-1)}$ moving through transfer subsystem 50 that includes transfer member 112 (ITM1) forming a pressure nip with a transfer backup member 113 (TR1). Similar functions are provided by the components of the other printing modules 32, 33, 34, 35. The direction of transport of the receivers is the slow-scan direction; the perpendicular direction, parallel to the axes of the intermediate transfer members 112, 122, 132, 142, 152, is the fast-scan direction.

A receiver, $R_n$, arriving from supply unit 40 (FIG. 1), is shown passing over roller 102 for subsequent entry into the transfer subsystem 50 of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35, respectively. An unfused print image formed on receiver $R_{(n-6)}$ is moving as shown towards fuser module 60 (FIG. 1).

A power supply 105 provides individual transfer currents to the transfer backup members 113, 123, 133, 143, 153. LCU 99 (FIG. 1) provides timing and control signals to the components of printer 100 in response to signals from sensors in printer 100 to control the components and process control parameters of the printer 100. Cleaning station 86 for transport web 81 permits continued reuse of transport web 81. A densitometer array includes a transmission densitometer 104 using a light beam 110. The densitometer array measures optical densities of toner control patches transferred to an inter-frame area 109 located on transport web 81, such that one or more signals are transmitted from the densitometer array to a computer or other controller (not shown) with corresponding signals sent from the computer to power supply 105. Transmission densitometer 104 is preferably located between printing module 35 and roller 103. Reflection densitometers, and more or fewer test patches, can also be used.

FIG. 3 shows additional details of printing module 31, which is representative of printing modules 32, 33, 34, and 35 (FIG. 1). Photoreceptor 206 of imaging member 111 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors 206 can also contain multiple layers.

Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210.

An exposure subsystem 220 is provided for selectively modulating the uniform electrostatic charge on photoreceptor 206 in an image-wise fashion by exposing photoreceptor 206 to electromagnetic radiation to form a latent electrostatic image. The uniformly-charged photoreceptor 206 is typically exposed to actinic radiation provided by selectively activating particular light sources in an LED array or a laser device outputting light directed onto photoreceptor 206. In embodiments using laser devices, a rotating polygon (not shown) is used to scan one or more laser beam(s) across the photoreceptor in the fast-scan direction. One pixel site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each pixel site in the row during that line exposure time.

As used herein, an "engine pixel" is the smallest addressable unit on photoreceptor 206 or receiver media 42 (FIG. 1) which the exposure subsystem 220 (e.g., the laser or the LED) can expose with a selected exposure different from the exposure of another engine pixel. Engine pixels can overlap (e.g., to increase addressability in the slow-scan direction S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

In a preferred embodiment, meter 212 is provided to measure the post-exposure surface potential within a patch area of a latent image formed from time to time in a non-image area on photoreceptor 206. Other meters and components can also be included (not shown).

A development station 225 includes toning shell 226, which can be rotating or stationary, for applying toner of a selected color to the latent image on photoreceptor 206 to produce a visible image on photoreceptor 206 (e.g., of a separation corresponding to the color of toner deposited at this printing module). Development station 225 is electrically biased by a suitable respective voltage to develop the respective latent image, which voltage can be supplied by a power supply (not shown). Developer is provided to toning shell 226 by a supply system (not shown) such as a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In some embodiments, the development station 225 employs a two-component developer that includes toner particles and magnetic carrier particles. The exemplary development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., and in U.S. Pat. No. 6,728,503 to Stelter et al., the disclosures of which are incorporated herein by reference. Development station 225 can also employ a mono-component developer comprising toner, either magnetic or non-magnetic, without separate magnetic carrier particles.

Transfer subsystem 50 includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., receiver media 42*c*) which receives a respective toned print images 38 from each printing module in superposition to form a composite image thereon. The print image 38 is, for example, a separation of one color, such as cyan. Receiver media 42*c*, 42*d* are transported by transport web 81. Transfer to a receiver is effected by an electrical field provided to transfer backup member 113 by power source 240, which is controlled by LCU 99. Receiver media 42*c*, 42*d* can be any objects or surfaces onto which toner can be transferred from imaging member 111 by application of the electric field. In this example, receiver media 42*c* is shown prior to entry into a second transfer nip 202, and receiver media 42*d* is shown subsequent to transfer of the print image 38 onto receiver media 42*d*.

In the illustrated embodiment, the toner image is transferred from the photoreceptor 206 to the intermediate transfer member 112, and from there to the receiver media 42*c*. Registration of the separate toner images is achieved by registering the separate toner images on the receiver media 42*c*, as is done with the NexPress 2100. In some embodiments, a single transfer member is used to sequentially transfer toner images from each color channel to the receiver media 42*c*. In other embodiments, the separate toner images can be transferred in register directly from the photoreceptor 206 in the respective printing module 31, 32, 33, 34, 25 to the receiver media 42*c* without using a transfer member. Either transfer process is suitable when practicing this invention. An alternative method of transferring toner images involves transferring the separate toner images, in register, to a transfer member and then transferring the registered image to a receiver. This method of printing an electrophotographic image is generally not suitable for use with the present invention.

LCU 99 sends control signals to the charging subsystem 210, the exposure subsystem 220, and the respective development station 225 of each printing module 31, 32, 33, 34, 35 (FIG. 1), among other components. Each printing module can also have its own respective controller (not shown) coupled to LCU 99.

Further details regarding exemplary printer 100 are provided in U.S. Pat. No. 6,608,641 to Alexandrovich et al., and in U.S. Patent Application Publication 2006/0133870, to Ng et al., the disclosures of which are incorporated herein by reference.

Figure 4:
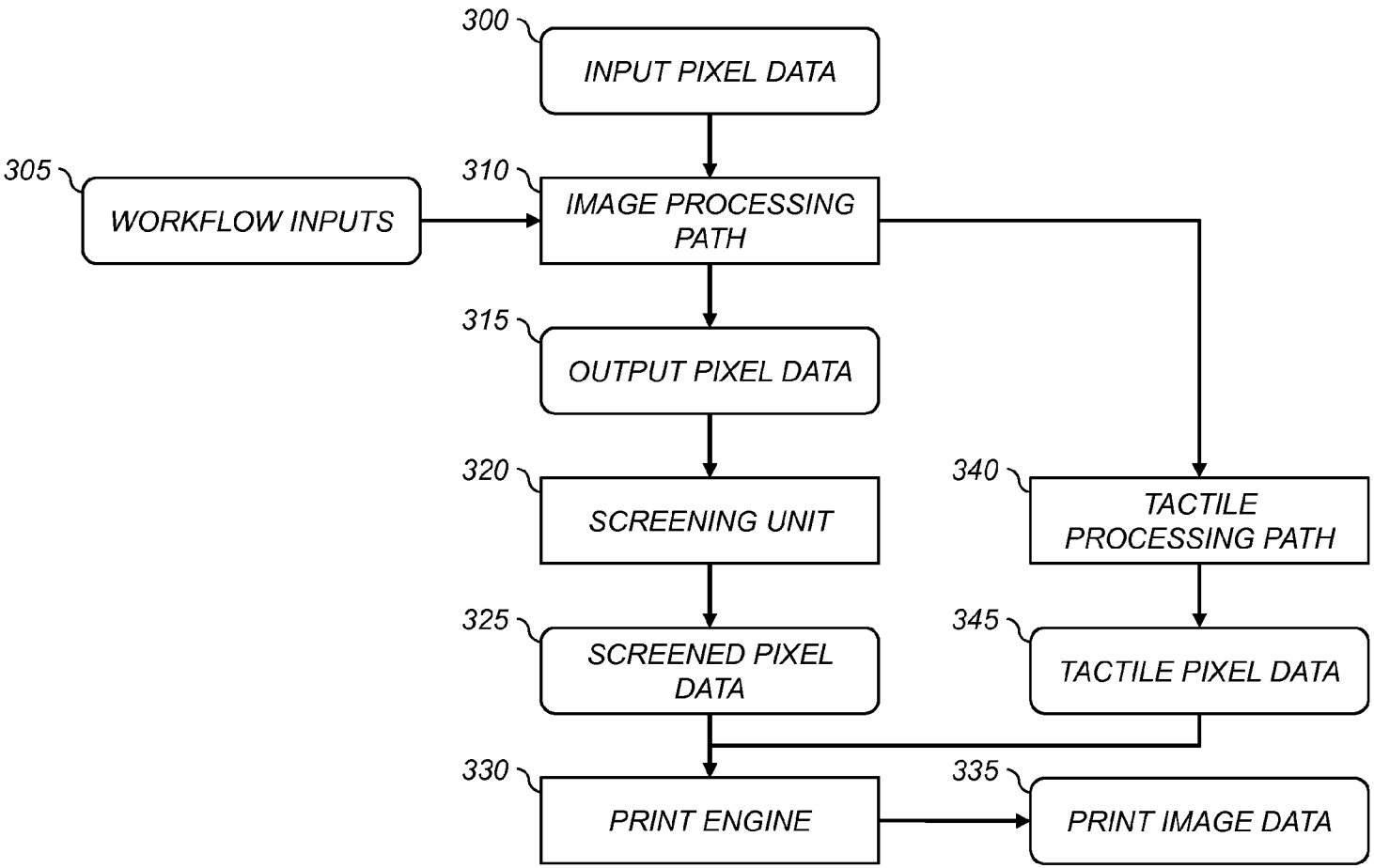
FIG. 4 is flowchart of a data-processing path useful with various embodiments.

FIG. 4 shows a data-processing path useful with various embodiments, and defines several terms used herein. Printer 100 (FIG. 1) or corresponding electronics (e.g., the DFE or RIP), operate this data-processing path to produce print image data 335 corresponding to an exposure pattern to be applied to photoreceptor 206 of imaging member 111 (FIG. 3), as described above. The data-processing path can be partitioned in various ways between the DFE, the RIP and the print engine, as is known in the image-processing art.

The following discussion relates to input pixel data 300 having a set of input channels specifying an image to be printed by the printer 100. In accordance with the present invention, the input channels can include a set of color channels, as well as one or more channels specifying a tactile pattern to be formed using the printer 100. The input pixel data 300 have an associated bit-depth, where the term "bit depth" refers to the range and precision of pixel values. In operation, data processing takes place for a plurality of input pixels that together compose an input image. The input image has an input resolution, where the term "resolution" herein refers to spatial resolution, (e.g., in cycles/inch or cycles/degree). Each input pixel has a corresponding pixel location within the input image, where the pixel location refers to a set of coordinates on the surface of receiver media 42 (FIG. 1) at which a corresponding amount of toner should be applied.

The printer 100 (FIG. 1) receives the input pixel data 300 and stores it in a memory buffer for further processing and printing. The input pixel data 300 generally is represented by input pixel values specifying pixel colors for an array of image pixels. The color of the input pixels can be represented using color channels corresponding to any appropriate color space known in the art. For example, the color values can be represented using sRGB code values, having 8-bit input pixel values for red (R), green (G), and blue (B) color channels. There is one input pixel level for each color channel. In accordance with the present invention, the input pixel data 300 also includes tactile image data specifying a tactile pattern that is to be produced. In a preferred embodiment, the tactile pattern is defined using tactile pixels values for an additional tactile input channel.

Image processing path 310 applies various image processing and color processing operations to convert the input pixel data 300 to corresponding output pixel data 315. Generally, the output pixel data 315 will be in an output color space corresponding to the colorants available in the printing modules 31-35 of the printer 100. The output pixel data 315 specify desired amounts of the corresponding colorants, which can be, for example, cyan, magenta and yellow (CMY) or cyan, magenta, yellow and black (CMYK) or cyan, magenta, yellow, black and clear (CMYK-clear). Output pixel data 315 can be linear or non-linear with respect to exposure, density, L*, toner mass, or any other factor known in the art.

The image processing path 310 transforms the input pixel data 300 to the corresponding output pixel data 315 responsive to appropriate workflow inputs 305 using any method known in the art. In some embodiments, the image processing path 310 first uses an input device model to transform the input color values to device-independent color values in a device-independent color space such as the well-known ROMM RGB, CIE XYZ and CIELAB color spaces. In some cases, the CIELAB can be encoded according to the well-known ICC Profile Connection Space (PCS) LAB color encoding. An inverse device model for the printer 100 is then used to transform the device-independent color values to determine corresponding output pixel data 315 that will produce the desired image colorimetry. In some cases, the output pixel data 315 can be encoded according to a standard CMYK color space such as SWOP CMYK (ANSI CGATS TR001 and CGATS.6), Euroscale (ISO 2846-1:2006 and ISO 12647), or other CMYK standards. In some embodiments, these transformations are performed using a color management system, such as the well-known ICC color management system.

Input pixels are associated with an input resolution in pixels per inch (ippi, input pixels per inch), and output pixels with an output resolution (oppi, output pixels per inch). Image processing path 310 resizes the image (e.g., using bilinear or bicubic interpolation) to modify the resolution when ippi≠oppi. In some cases, different operations in the data path are preferably at different resolutions. In this case, suitable resizing operations can be performed between the different operations.

Screening unit 320 calculates screened pixel data 325 from output pixel data 315. The screened pixel data 325 are at the bit depth required by print engine 330 to produce the print image data 335, which generally corresponds to the number of printable levels that can be produced by the printer 100. The screening unit 320 can perform continuous-tone processing operations, as well as halftone processing or multitone processing (i.e., multi-level halftone processing). The halftone or multitone processing operations can use any type of algorithm known in the art including periodic dither or error diffusion. In some embodiments, the screening unit 320, includes a screening memory for storing data such as dither matrices that is used by the halftone/multitone algorithm.

Print engine 330 represents the subsystems in printer 100 that apply an amount of toner corresponding to the screened pixel data to receiver media 42 (FIG. 1) at the respective pixel locations. Examples of these subsystems are described above with reference to FIGS. 1-3. The screened pixel data 325 and corresponding locations can be the engine pixel levels and locations, or additional processing can be performed to transform the screened pixel data 325 into the engine pixel levels and locations.

According to the present invention, tactile images (i.e., images having a pattern that can be sensed by touching) are produced on an electrophotographic printer. An example of a type of tactile image would be Braille images, which are designed to convey information to a visually impaired person. In other cases, the tactile image can be some other type of texture pattern that is to be applied to the surface of the printed image, such as the tactile patterns that are described in commonly-assigned, U.S. patent application Ser. No. 13/461,875 to Delmerico, entitled "Printed image for visually-impaired person," which is incorporated herein by reference. Such tactile patterns are generally made up of patterns of individual texture features such as small dots and lines, each of which can be provided in accordance with the present invention.

In a preferred embodiment, the tactile features are formed by depositing marking particles on the receiver medium that alter the coefficient of friction of the image surface. In some embodiments, the tactile features can also provide a macroscopic surface relief that cooperates together with the difference in the coefficient of friction to enhance the ability of a user to sense the tactile pattern. Tactile pixel data 345 specifying the pattern of tactile features to be printed in registration with the screened pixel data 325 are also provided by the image processing path 310.

In a preferred embodiment, the tactile pixel data 345 will be an array of binary pixel values. The binary pixel values can have either a first state for pixel positions where no tactile features are to be formed, or can have a second state for pixel positions where tactile features are to be formed by depositing appropriate marking particles. In other embodiments, the tactile pixel data 345 can take on more than two pixel values corresponding to different magnitudes of the tactile feature.

Appropriate processing operations can be provided by a tactile processing path 340 to determine the tactile pixel data 345 given the information describing the tactile pattern that is specified by the input pixel data 300 and provided by the image processing path 310. For example, in some embodiments, the information describing the tactile pattern may be a tactile pattern code value specifying which texture pattern from a predefined set of texture patterns should be printed at each pixel location. The tactile processing path 340 can then form the tactile pixel data 345 an amount of the marking particles (e.g., toner particles) that provide the tactile effect should be deposited at each pixel location of the printed image. The tactile pixel data 345 are provided to the print engine 330 together with the screened pixel data 325 to provide the print image data 335 for each of the printing modules 31, 32, 33, 34, 35 (FIG. 1). The print image data 335 will generally be stored in a memory buffer until such time as it is printed.

When practicing this invention, it is preferred that the fuser heat the toner to a temperature in excess of the glass transition temperature without subjecting the toner patterns to excessive pressure so as to avoid reducing the height of the desired surface relief patterns. One way to accomplish this is to use a highly compliant fusing roller 62, such as one having a foam coating, where the foam has a Young's modulus of less than 200 KPa. This can provide a fusing nip 66 with a substantially reduced pressure. However, as this method still brings the fusing roller 62 into contact with the toner particles, it can still reduce the height of the toner stack to some degree. In a more preferred embodiment, no pressure roller 64 is used and the fusing roller 62 is brought into contact with the non-image-bearing side of the receiver media 42. In this way, heat is added to the toner without applying any pressure. Similarly, in some embodiments, instead of a fusing roller 62, a heated member of finite width such as a hot shoe can be used. In a preferred embodiment, the image-bearing receiver media 42 can be fixed using a non-contact fixing system which does not contact the receiver media 42, and more specifically does not contact the image-bearing side of receiver media 42. Any such method known in the art can be used in accordance with the present invention, such as radiant heating, RF heating, IR heating, convective heating, or microwave heating.

Toner Particles

A preferred embodiment of the present invention provides dry toner particles and compositions of multiple dry toner particles in dry developers that can be used for reproduction of a tactile effect, by an electrostatic printing process, especially by an electrophotographic imaging process.

The toner particles of the present invention consist essentially of a polymeric binder which, when fixed (or fused), provide the tactile effects described herein. These toner particles can be used as the sole toner particles in an image forming process, or they can be used in combination with other color toner particles that provide one or more tactile features in a toner image. In some embodiments, optional additives (described below) can be incorporated into or with the toner particles to provide various properties that are useful for electrostatic printing processes. However, only the polymeric binder is essential for providing the tactile effects and for this purpose, they are the only essential components of the toner particles of this invention.

The polymeric binder phase is generally a continuous polymeric phase comprising one or more polymeric binders that are suitable for the various imaging methods described herein. Many useful binder polymers are known in the art as being suitable for forming toner particles as they will behave properly during thermal fixing of the toner particles to a suitable receiver material. Such polymeric binders generally are amorphous and each has a glass transition temperature ($T_g$) of at least 50° C. and up to and including 100° C. In addition, the toner particles prepared from these polymeric binders have a caking temperature of at least 50° C. so that the toner particles can be stored for relatively long periods of time at fairly high temperatures without having individual particles agglomerate and clump together.

Useful polymeric binders for providing the polymeric binder phase include but are not limited to, polycarbonates, resin-modified malic alkyd polymers, polyamides, phenol-formaldehyde polymers and various derivatives thereof, polyester condensates, modified alkyd polymers, aromatic polymers containing alternating methylene and aromatic units, and fusible crosslinked polymers.

Other useful polymeric binders are vinyl polymers, such as homopolymers and copolymers derived from two or more ethylenically unsaturated polymerizable monomers. For example, useful copolymers can be derived one or more of styrene or a styrene derivative, vinyl naphthalene, p-chlorostyrene, unsaturated mono-olefins such as ethylene, propylene, butylene, and isobutylene, vinyl halides such as vinyl chloride, vinyl bromide, and vinyl fluoride, vinyl acetate, vinyl propionate, vinyl benzoate, vinyl butyrate, vinyl esters such as esters of mono carboxylic acids including acrylates and methacrylates, acrylonitrile, methacrylonitrile, acrylamides, methacrylamide, vinyl ethers such as vinyl methyl ether, vinyl isobutyl ether, and vinyl ethyl ether, N-vinyl indole, N-vinyl pyrrolidone, and others that would be readily apparent to one skilled in the electrophotographic polymer art.

For example, homopolymers and copolymers derived from styrene or styrene derivatives can comprise at least 40 weight % and to and including 100 weight % of recurring units derived from styrene or styrene derivatives (homologs) and from 0 to and including 40 weight % of recurring units derived from one or more lower alkyl acrylates or methacrylates (the term "lower alkyl" means alkyl groups having 1 to 6 carbon atoms). Other useful polymers include fusible styrene-acrylic copolymers that are partially crosslinked by incorporating recurring units derived from a divinyl ethylenically unsaturated polymerizable monomer such as divinylbenzene or a diacrylate or dimethacrylate. Polymeric binders of this type are described, for example, in U.S. Reissue Pat. No. 31,072 (Jadwin et al.) that is incorporated herein by reference. Mixtures of such polymeric binders can be used if desired in the toner particles.

Some useful polymeric binders are derived from styrene or another vinyl aromatic ethylenically unsaturated polymerizable monomer and one or more alkyl acrylates, alkyl methacrylates, or dienes wherein the styrene recurring units comprise at least 60% by weight of the polymer. For example, copolymers that are derived from styrene and either butyl acrylate or butadiene are also useful as polymeric binders, or these copolymers can be part of blends of polymeric binders. For example, a blend of poly(styrene-co-butyl acrylate) and poly(styrene-co-butadiene) can be used wherein the weight ratio of the first polymeric binder to the second polymeric binder is from 10:1 to 1:10, or from 5:1 to 1:5.

Styrene-containing polymers are particularly useful and can be derived from one or more of styrene, α-methylstyrene, p-chlorostyrene, and vinyl toluene. Useful alkyl acrylates, alkyl methacrylates, and monocarboxylic acids that can be copolymerized with styrene or styrene derivatives include but are not limited to, acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, ethyl methacrylate, butyl methacrylate, and octyl methacrylate.

Condensation polymers are also useful as polymeric binders in the toner particles. Useful condensation polymers include but are not limited to, polycarbonates, polyamides, polyesters, polywaxes, epoxy resins, polyurethanes, and polymeric esterification products of a polycarboxylic acid and a diol comprising a bisphenol. Particularly useful condensation polymeric binders include polyesters and copolyesters that are derived from one or more aromatic dicarboxylic acids and one or more aliphatic diols, including polyesters derived from isophthalic or terephthalic acid and diols such as ethylene glycol, cyclohexane dimethanol, and bisphenols (such as Bisphenol A). Other useful polyester binders can be obtained by the co-polycondensation polymerization of a carboxylic acid component comprising a carboxylic acid having two or more valencies, an acid anhydride thereof or a lower alkyl ester thereof (for example, fumaric acid, maleic acid, maleic anhydride, phthalic acid, terephthalic acid, trimellitic acid, or pyromellitic acid), using as a diol component a bisphenol derivative or a substituted compound thereof. Other useful polyesters are copolyesters prepared from terephthalic acid (including substituted terephthalic acid), a bis[(hydroxyalkoxy)phenyl]alkane having 1 to 4 carbon atoms in the alkoxy radical and from 1 to 10 carbon atoms in the alkane moiety (that can also be a halogen-substituted alkane), and an alkylene glycol having from 1 to 4 carbon atoms in the alkylene moiety. Specific examples of such condensation copolyesters and how they are made are provided for example in U.S. Pat. No. 5,120,631 (Kanbayashi et al.), U.S. Pat. No. 4,430,408 (Sitaramiah), and U.S. Pat. No. 5,714,295 (Wilson et al.), all of which are incorporated herein by reference for describing such polymeric binders. A useful polyester is a propoxylated bisphenol—A fumarate.

Useful polycarbonates are described in U.S. Pat. No. 3,694,359 (Merrill et al.) that is incorporated by reference, which polycarbonates can contain alklidene diarylene moieties in recurring units.

Other specific polymeric binders useful in the toner particles are described in paragraph [0031] of U.S. Patent Application Publication 2011/0262858, which is incorporated herein by reference.

In some embodiments, the polymeric binder phase comprises a polyester or a vinyl polymer derived at least in part from styrene or a styrene derivative, both of which are described above.

In general, one or more polymeric binders are present in the toner particles in an amount of at least 50 weight % and up to and including 80 weight %, or typically at least 60 weight % and up to and including 75 weight %, based on the total toner weight.

The tactile toner particles of this invention are not generally perfectly spherical so it is best to define them by the mean volume weighted diameter ($D_{vol}$) that can be determined as described above. Before fixing, the $D_{vol}$ is generally at least 15 μm and up to and including 40 μm and typically at least 20 μm and up to and including 30 μm. When these tactile toners are used with other CYMK toners, the mean average volume weighted diameter of these color toners would typically range from 4 to 12 μm.

Various optional additives that can be present in the toner particles can be added in the dry blend of resin particles described below. Such optional additives include but are not limited to, colorants (such as dyes and pigments) non-conductive metal oxide particles, charge control agents, waxes, fuser release aids, leveling agents, surfactants, stabilizers, or any combinations of these materials. These additives are generally present in amounts that are known to be useful in the electrophotographic art as they are known to be used in other toner particles, including color toner particles. Many of these additives provide a low surface energy that will help lower the coefficient of friction of the toner patterns following the fixing step. On the other hand, if polymeric materials consisting of, for example, rubber component are incorporated in toner, they could help increase the resulting coefficient of friction. The coefficient of friction can also be increased with the incorporation of toner additives that help increase the surface roughness of the fused image. For example, abrasive materials such as clay, calcium carbonate or alumina can be added to the toner. A similar effect could also be produced by employing higher molecular weight or cross-linked toner resins. By selecting appropriate toner compositions, the extent of surface asperities and the magnitude of these asperities can be adjusted to control the magnitude of the surface roughness, and thereby to control the coefficient of friction.

In addition of the chemical nature of the material, the coefficient of friction can also be affected by the surface roughness. Dynamic coefficient of friction is also affected by the conditions where measurements are being made. The relative difference in the coefficient of friction could be further enhanced by altering the temperature, humidity and pressure.

In some embodiments, a spacing agent, fuser release aid, flow additive particles, or combinations of these materials can be provided on the outer surface of the toner particles, and such materials are provided in amounts that are known in the electrophotographic art. Generally, such materials are added to the toner particles after they have been prepared using the dry blending, melt extrusion, and breaking process (described below).

Inorganic or organic colorants (pigments or dyes) can be present in the toner particles to provide any suitable color, tone, or hue in addition to the tactile properties to render them more visible. Some toner particles of this invention are free of additional colorants.

Colorants can be incorporated into the polymeric binders in known ways, for example by incorporating them in the dry blends described below. Useful colorants include but are not limited to, titanium dioxide, carbon black, Aniline Blue, Calcoil Blue, Chrome Yellow, Ultramarine Blue, DuPont Oil Red, Quinoline Yellow, Methylene Blue Chloride, Malachite Green Oxalate, Lamp Black, Rose Bengal, Colour Index Pigment Red 48:1, Colour Index Pigment Red 57:1, Colour Index Pigment Yellow 97, Colour Index Pigment Yellow 17, Colour Index Pigment Blue 15:1, Colour Index Pigment Blue 15:3, phthalocyanines such as copper phthalocyanine, monochlor copper phthalocyanine, hexadecachlor copper phthalocyanine, Phthalocyanine Blue or Colour Index Pigment Green 7, and quinacridones such as Colour Index Pigment Violet 19 or Colour Index Pigment Red 122, and pigments such as HELIOGEN Blue™, HOSTAPERM Pink™, NOVAPERM Yellow™, LITHOL Scarlet™, MICROLITH Brown™, SUDAN Blue™, FANAL Pink™, and PV FAST Blue™. Such pigments do not include the non-conductive metal oxide particles that are also present in the toner particles. Mixtures of colorants can be used. Other suitable colorants are described in U.S. Reissue Pat. 31,072 (noted above) and U.S. Pat. No. 4,160,644 (Ryan), U.S. Pat. No. 4,416,965 (Sandhu et al.), and U.S. Pat. No. 4,414,152 (Santilli et al.), all of which are incorporated herein by reference.

One or more of such colorants can be present in the toner particles in an amount of at least 1 weight % and up to and including 20 weight %, or typically at least 2 to and including 15 weight %, based on the total toner particle weight, but a skilled worker in the art would know how to adjust the amount of colorant so that the desired tactile effect can be obtained with the colorants in the toner particles.

The colorants can also be encapsulated using elastomeric resins that are included within the toner particles. Such a process is described in U.S. Pat. No. 5,298,356 (Tyagi et al.) that is incorporated herein by reference.

The toner particles of this invention can comprise non-conductive metal oxide particles (such as mica, silica, titania or alumina particles) in combination with a yellow, cyan, magenta, or black colorant, or mixtures thereof. Such toner particles can be used in various mono-component developers or two-component developers that are described in more detail below. A mixture of different metal oxides could also be used. The non-conductive metal oxides can include one or more dry coatings of different metal oxides such as an oxide of iron, silicon, titanium, aluminum, and the like. In addition, the metal oxide particles can also include a dry organic layer on at least part of the outer surface and over the other metal oxides coatings. The non-conductive metal oxide particles are generally present in the toner particles of this invention in an amount of at least 20 weight % and up to and including 50 weight %, or typically of at least 25 weight % and up to and including 40 weight %, based on total toner particle weight.

Suitable charge control agents and their use in toner particles are well known in the art as described for example in the *Handbook of Imaging* Materials, 2$^{nd}$ Edition, Marcel Dekker, Inc., New York, ISBN: 0-8247-8903-2, pp. 180ff and references noted therein. The term "charge control" refers to a propensity of the material to modify the triboelectric charging properties of the toner particle. A wide variety of charge control agents can be used as described in U.S. Pat. No. 3,893,935 (Jadwin et al.), U.S. Pat. No. 4,079,014 (Burness et al.), U.S. Pat. No. 4,323,634 (Jadwin et al.), U.S. Pat. No. 4,394,430 (Jadwin et al.), U.S. Pat. No. 4,624,907 (Motohashi et al.), U.S. Pat. No. 4,814,250 (Kwarta et al.), U.S. Pat. No. 4,840,864 (Bugner et al.), U.S. Pat. No. 4,834,920 (Bugner et al.), and U.S. Pat. No. 4,780,553 (Suzuka et al.), all of which are incorporated herein by reference. The charge control agents can be transparent or translucent and free of pigments and dyes. Generally, these compounds are colorless or nearly colorless. Mixtures of charge control agents can be used. A desired charge control agent can be chosen depending upon whether a positive or negative charging toner particle is needed.

Examples of useful charge control agents include but are not limited to, triphenylmethane compounds, ammonium salts, aluminum-azo complexes, chromium-azo complexes, chromium salicylate organo-complex salts, azo-iron complex salts, an azo-iron complex salt such as ferrate (1-), bis[4-[5-chloro-2-hydroxyphenyl)azo]-3-hydroxy-N-phenyl-2-naphthalene-carboxamidato(2-)], ammonium, sodium, or hydrogen (Organoiron available from Hodogaya Chemical Company Ltd.). Other useful charge control agents include but are not limited to, acidic organic charge control agents such as 2,4-dihydro-5-methyl-2-phenyl-3H-pyrazol-3-one (MPP) and derivatives of MPP such as 2,4-dihydro-5-methyl-2-(2,4,6-trichlorophenyl)-3H-pyrazol-3-one, 2,4-dihydro-5-methyl-2-(2,3,4,5,6-pentafluorophenyl)-3H-pyrazol-3-one, 2,4-dihydro-5-methyl-2-(2-trifluoroethylphenyl)-3H-pyrazol-3-one and the corresponding zinc salts derived therefrom. Other examples include charge control agents with one or more acidic functional groups, such as fumaric acid, malic acid, adipic acid, terephthalic acid, salicylic acid, fumaric acid monoethyl ester, copolymers derived from styrene and methacrylic acid, copolymers of styrene and lithium salt of methacrylic acid, 5,5'-methylenedisalicylic acid, 3,5-di-t-butylbenzoic acid, 3,5-di-t-butyl-4-hydroxybenzoic acid, 5-t-octylsalicylic acid, 7-t-butyl-3-hydroxy-2-napthoic acid, and combinations thereof. Still other acidic charge control agents which are considered to fall within the scope of the invention include N-acylsulfonamides, such as, N-(3,5-di-t-butyl-4-hydroxybenzoyl)-4-chlorobenzenesulfonamide and 1,2-benzisothiazol-3(2H)-one 1,1-dioxide. Another class of charge control agents include, but are not limited to, iron organo metal complexes such as organo iron complexes, for example T77 from Hodogaya. Still another useful charge control agent is a quaternary ammonium functional acrylic polymer.

Other useful charge control agents include alkyl pyridinium halides such as cetyl pyridinium halide, cetyl pyridinium tetrafluoroborates, quaternary ammonium sulfate, and sulfonate charge control agents as described in U.S. Pat. No. 4,338,390 (Lu Chin), which is incorporated herein by reference, stearyl phenethyl dimethyl ammonium tosylates, distearyl dimethyl ammonium methyl sulfate, and stearyl dimethyl hydrogen ammonium tosylate.

One or more charge control agents can be present in the non-porous dry toner particles in an amount to provide a consistent level of charge of at least −40 μCoulomb/g to and including −5 μCoulomb/g, when charged. Examples of suitable amounts include at least 0.1 weight % to and including 10 weight %, based on the total toner particle weight.

Useful waxes (can also be known as lubricants) that can be present in the toner particles include low molecular weight polyolefins (polyalkylenes) such as polyethylene, polypropylene, and polybutene, such as Polywax 500 and Polywax 1000 waxes from Peterolite, Clariant PE130 and Licowax PE190 waxes from Clariant Chemicals, and Viscol 550 and Viscol 660 waxes from Sanyo. Also useful are ester waxes that are available from Nippon Oil and Fat under the WE-series. Other useful waxes include silicone resins that can be softened by heating, fatty acid amides such as oleamide, erucamide, ricinoleamide, and stearamide, vegetable waxes such as carnauba wax, rice wax, candelilla wax, Japan wax, and jojoba wax, animal waxes such as bees wax, mineral and petroleum waxes such as montan wax, ozocerite, ceresine, paraffin wax, microcrystalline wax, and Fischer-Tropsch wax, and modified products thereof. Irrespective to the origin, waxes having a melting point in the range of at least 30° C. and up to and including 150° C. are useful. One or more waxes can be present in an amount of at least 0.1 weight % and up to and including 20 weight %, or at least 1 weight % and up to and including 10 weight %, based on the total toner particle weight. These waxes, especially the polyolefins, can be used also as fuser release aids. In some embodiments, the fuser release aids are waxes having 70% crystallinity as measured by differential scanning calorimetry (DSC).

In general, a useful wax has a number average molecular weight ($M_n$) of at least 500 and up to and including 7,000. Polyalkylene waxes that are useful as fuser release aids can have a polydispersity of at least 2 and up to and including 10 or typically of at least 3 and up to and including 5. Polydispersity is a number representing the weight average molecular weight ($M_w$) of the polyalkylene wax divided by its number average molecular weight ($M_n$).

Surface treatment agents can also be on the outer surface of the toner particles in an amount sufficient to permit the toner particles to be stripped from carrier particles in a dry two-component developer by electrostatic forces associated with the charged image or by mechanical forces. Surface fuser release aids can be present on the outer surface of the toner particles in an amount of at least 0.05 weight % to and including 1 weight %, based on the total dry weight of toner particles. These materials can be applied to the outer surfaces of the toner particles using known methods for example by powder mixing techniques.

Spacing treatment agent particles (also known as "spacer particles") can be attached to the outer surface by electrostatic forces or physical means, or both. Useful surface treatment agents include but are not limited to, silica such as those commercially available from Degussa as R972 and RY200 or from Wasker as H2000. Other suitable surface treatment agents include but are not limited to, titania, aluminum, zirconia, or other metal oxide particles, and polymeric beads all generally having an ECD of less than 1 μm. Mixtures of these materials can be used if desired, for example a mixture of hydrophobic silica and hydrophobic titania particles.

Preparation of Toner Particles

In a typical manufacturing method for preparing the toner particles of this invention, a desired polymer binder (or mixture of polymeric binders) for use in the toner particles is produced independently using the polymerization processes described above.

The one or more polymeric binders are provided as resin particles are dry blended or mixed as described above to form a dry blend. The optional additives, such as charge control agents, waxes, fuser release aids, and colorants can also be incorporated into the dry blend with the two essential components.

The amounts of the essential and optional components can be adjusted in the dry blend in a suitable manner that a skilled worker would readily understand to provide the desired amounts in the resulting toner particles. The conditions and apparatus for mechanical dry blending are known in the art. For example, the method can comprise dry blending the resin particles with colorants, non-conductive mica particles and a charge control agent, and optionally with a wax or colorant, or any combination of these optional components, to form a dry blend. The dry blend can be prepared by mechanically blending the components for a suitable time to obtain a uniform dry mix.

The dry blend is then melt processed in a suitable extrusion device such as a two-roll mill or hot-melt extruder. In particular, the dry melt is extruded under low shear conditions in an extrusion device to form an extruded composition. The "low shear conditions" are advantageous in order to minimize breakage of the non-conductive metal oxide flakes, and thus provide maximum tactile effect (for example luster) in the final toner image. The melt processing time can be from 1 minute to and including 60 minutes, and the time can be adjusted by a skilled worker to provide the desired melt processing temperature and uniformity in the resulting extruded composition.

For example, it is useful to melt extrude a dry blend of the noted components that has a viscosity of at least 90 pascals sec to and including 2300 pascals sec, or typically of at least 150 pascals sec to and including 1200 pascals sec. This control of melt viscosity also reduces shear conditions and thus reduces breakage of the non-conductive metal oxide particles, if used in the toner composition.

Generally, the dry blend is melt extruded in the extrusion device at a temperature higher than the glass transition temperature of the one or more polymeric binders used to form the polymeric binder phase, and generally at a temperature of at least 90° C. and up to and including 240° C. or typically of at least 120° C. and up to and including 160° C. The temperature results, in part, from the frictional forces of the melt extrusion process.

The resulting extruded composition (sometimes known as a "melt product" or a "melt slab") is generally cooled, for example, to room temperature, and then broken up (for example pulverized) into toner particles having the desired $D_{vol}$ of at least 15 μm and up to and including 40 μm and typically of at least 20 μm and up to and including 30 μm. It is generally best to first grind the extruded composition prior to a specific pulverizing operation. Grinding can be carried out using any suitable procedure. For example, the extruded composition can be crushed and then ground using for example a fluid energy or jet mill as described for example in U.S. Pat. No. 4,089,472 (Seigel et al.). The particles can then be further reduced in size by using high shear pulverizing devices such as a fluid energy mill, and then appropriately classified to desired sizes.

Each of the toner particles prepared in this manner consists essentially of a polymeric binder phase formed from the resin particles, and any optional additives are also distributed within (usually uniformly) the polymeric binder phase.

The resulting toner particles can then be surface treated with suitable hydrophobic flow additive particles having an equivalent circular diameter (ECD) of at least 5 nm and up to a desired size, to affix such hydrophobic flow additive particles on the outer surface of the toner particles. These hydrophobic flow additive particles can be composed of metal oxide particles such as hydrophobic fumed oxides such as silica, alumina, or titania in an amount of at least 0.01 weight % and up to and including 10 weight % or typically at least 0.1 weight % and up to and including 5 weight %, based on the total toner particle weight.

In particular, a hydrophobic fumed silica such as R972 or RY200 (from Nippon Aerosil) can be used for this purpose, and the amount of the fumed silica particles can be as noted above, or more typically at least 0.1 weight % and up to and including 3 weight %, based on the total toner particle weight.

The hydrophobic flow additive particles can be added to the outer surface of the toner particles by mixing both types of particles in a 10 liter Henschel mixer for at least 2 minutes and up to 2000 rpm.

The resulting treated toner particles can be further classified (sieved) through a 230 mesh vibratory sieve to remove non-attached silica particles, silica agglomerates, and any non-conductive metal oxide particles that are outside the toner particles. The temperature during the surface treatment can be controlled to provide the desired attachment and blending.

Dry color toner particles useful to provide color toner images can be prepared in various ways, including the melt extrusion processes described above for the dry toner particles of this invention. Alternatively, the dry color toners can be prepared as "chemically prepared toners", "polymerized toners", or "in-situ toners". They can be prepared using controlled growing. Various chemical processes include suspension polymers, emulsion aggregation, micro-encapsulation, dispersion, and chemical milling. Details of such processes are described for example in the literature cited in [0010] of U.S. Patent Application Publication 2010/0164218 (Schulze-Hagenest et al.) that is incorporated herein by reference. Dry color toners can also be prepared using limited coalescence process as described in U.S. Pat. No. 5,298,356 (Tyagi et al.) that is incorporated herein by reference, or a water-in-oil-in-water double emulsion process as described in U.S. Patent Application Publication 2011/0262858 (Nair et al.), which is incorporated herein by reference, especially if porosity is desired in the dry color toners, but without the encapsulated metal flakes. Another method for preparing dry color toner particles is by a spray/freeze drying technique as described in U.S. Patent Application Publication 2011/0262654 (Yates et al.).

The various color toners can be provided using a suitable polymeric binder phase comprising one or more polymeric binders (as described above) and one or more cyan, yellow, magenta, or black colorants. The choice of particular colorants for the cyan, yellow, magenta, and black (CYMK) color toners is well described in the art. Other types of colorants include, but are not limited to, red, blue, and green pigments.

The amount of one or more colorants in the dry color toners can vary over a wide range and skilled worker in the art would know how to pick the appropriate amount for a given colorant or mixture of colorants. In general, the total colorants in each color toner can be at least 1 weight % and up to and including 40 weight %, or typically at least 3 weight % and up to and including 25 weight %, based on the total dry color toner weight. The colorant in each dry color toner can also have the function of providing charge control, and a charge control agent (as described above) can also provide coloration. All of the additives described above for the toner particles of this invention can likewise be used in the color toners, except that they do not contain the non-conductive metal oxide particles as described above.

Developers

The toner particles of this invention can be used as a mono-component developer, or combined with carrier particles to form two-component developers. In all of these embodiments, a plurality (usually thousands or millions) of individual toner particles are used together. The mono-component developers and two-component developers containing toner particles comprising mica particles are particularly useful and such mica particles can have an aspect ratio of at least 5.

Such mono-component or two-component developers generally comprise a charge control agent, wax, lubricant, fuser release aid, or any combination of these materials within the toner particles, or they can also include flow additive particles on the outer surface of the toner particles. Such components are described above.

Useful one-component developers generally include the toner particles of this invention as the sole essential component. Two-component developers generally comprise carrier particles (also known as carrier vehicles) that are known in the electrophotographic art and can be selected from a variety of materials. Carrier particles can be uncoated carrier core particles (such as magnetic particles) and core magnetic particles that are overcoated with a thin layer of a film-forming polymer such as a silicone resin type polymer, poly(vinylidene fluoride), poly(methyl methacrylate), or mixtures of poly(vinylidene fluoride) and poly(methyl methacrylate).

The amount of toner particles of the present invention in a two-component developer can be at least 2 weight % and up to and including 20 weight % based on the total dry weight of the two-component dry developer.

Image Formation Using Toner Particles

The toner particles of this invention can be applied to a suitable receiver material (or substrate) of any type using various methods such as a digital printing process, such as an electrostatic printing process, or electrophotographic printing process as is well-known in the art, or by an electrostatic coating process as described for example in U.S. Pat. No. 6,342,273 (Handels et al.), which is incorporated herein by reference.

Such receiver materials include, but are not limited to, coated or uncoated papers (cellulosic or polymeric papers), transparent polymeric films, ceramics, paperboard, cardboard, metals, fibrous webs or ribbons, and other substrate materials that would be readily apparent to one skilled in the art. In particular, the receiver materials (also known as the final receiver material or final receiver material) can be sheets of paper or polymeric films that are fed from a supply of receiver materials. The receiver materials could be further treated with coatings of inorganic or organic materials so as to alter the coefficient of friction of the receiver media with respect to the fused toner image.

For example, the toner particles, can be applied to a receiver material by a digital printing process such as an electrostatic printing process that includes but is not limited to, an electrophotographic printing process, or by a coating process such as an electrostatic coating process including an electrostatic brush coating as described in U.S. Pat. No. 6,342,273 (noted above).

In one electrophotographic method, a latent image (that is an electrostatic latent image) can be formed on a primary imaging member such as a charged photoconductor belt or roller using a suitable light source such as a laser or light emitting diode. This latent image is then developed on the primary imaging member by bringing the latent image into close proximity with a dry one-component or dry two-component developer comprising the toner particles of this invention to form a visible developed toner image on the primary imaging member.

In the embodiments of multi-color printing, multiple photoconductors can be used, each developing a separate color toner image and another for developing the toner image that provides a tactile effect. Alternatively, a single photoconductor can be used with multiple developing stations where after each tactile or color toner image is developed, it is transferred to the receiver material or to an intermediate transfer member (belt or rubber) and then to the receiver material after all of the toner images have been accumulated on the intermediate transfer member.

While the visible developed toner image can be transferred to a final receiver (receiver material) using a thermal or thermal assist process, it is generally transferred using an electrostatic process as is well-known in the art. The electrostatic transfer can be accomplished using a corona charger or an electrically biased transfer roller to press the receiver material into contact with the primary imaging member while applying an electrostatic field. In an alternative embodiment, the visible developed toner image can be first transferred from the primary imaging member to an intermediate transfer member (belt or roller) that serves as a receiver material, but not as the final receiver material, and then transferred from the intermediate transfer member to the final receiver material.

Electrophotographic color printing generally includes subtractive color mixing wherein different printing stations in a given apparatus are equipped with cyan, yellow, magenta, and black toner particles. Thus, a plurality of toner images of different colors can be applied to the same primary imaging member (such as dielectric member), intermediate transfer member, and final receiver material, including one or more color toner images in combination with the toner image comprising the toner particles of this invention that provide a tactile effect. Such different toner images are generally applied or transferred to the final receiver material in a desired sequence or succession using successive toner application or printing stations as described below.

The various transferred toner images are then fixed (thermally fused) on the receiver material in order to permanently affix them to the receiver material. This fixing can be done using various means such as heating alone (non-contact fixing) using an oven, hot air, radiant, or microwave fusing, or by passing the toner image(s) through a pair of heated rollers (contact fixing) to thereby apply both heat and pressure to the toner image(s) containing toner particles. Generally, one of the rollers is heated to a higher temperature and can have an optional release fluid to its surface. This roller can be referred to as the fuser roller, and the other roller is generally heated to a lower temperature and usually serves the function of applying pressure to the nip formed between the rollers as the toner image(s) is passed through. This second roller can be referred to as a pressure roller. Whatever fixing means is used, the fixing temperature is generally higher than the glass transition temperature of the toner particles, which $T_g$ can be at least 45° C. and up to and including 90° C. or at least 50° C. and up to and including 70° C. Thus, fixing is generally at a temperature of at least 95° C. and up to and including 220° C. or more generally at a temperature of at least 135° C. and up to and including 210° C.

As the visible developed toner image(s) on the receiver material is passed through the nip formed between the two rollers, the dry toner particles in the visible developed toner image(s) are softened as their temperature is increased upon contact with the fuser roller. The melted dry toner particles generally remain affixed on surface of the receiver material.

In some embodiments, a method for forming an image comprises: forming a toner image that provides a tactile effect on a receiver medium, and fixing the toner image that provides a tactile effect on the receiver material, wherein the toner image that provides a tactile effect is formed using toner particles, each of which consists essentially of a polymeric binder phase and some optional additives dispersed within the polymeric binder phase. A suitable receiver medium (or substrate) could include paper, polymeric sheets, cardboard, metal films or other packaging materials. In a preferred embodiment, each toner particle has a mean volume weighted diameter ($D_{vol}$) before fixing of at least 15 μm and up to and including 40 μm. In accordance with embodiments of the present invention, the resulting print image has a coefficient of friction difference between the tactile features formed by the fused toner and receiver media surface of at least 0.06, and preferably of at least 0.11.

In other embodiments, the method can also form at least one color toner image (e.g., cyan, magenta, yellow or black toner images) either over or under the toner image that provides the tactile effect. In accordance with the present invention, the resulting print image has a coefficient of friction difference between the tactile features formed by the fused toner and receiver surface that is at least 0.06, and preferably is at least 0.11. In some cases, there may be portions of the print image that have colored toner but do not have tactile features (i.e., they do not have any of the toner that provides the tactile effect). In some embodiments it can be desirable that there is a coefficient of friction difference between the tactile features formed by the fused toner and the portions of the receiver surface that have only colored toner is at least 0.06, and more preferably is at least 0.11. This enables tactile features to be formed independent of the visible image content.

It is advantageous that the present invention can be used in a printing apparatus with multiple printing stations, for example where the toner particles that provide the tactile effect can be applied to a receiver material at a first printing station, and one or more dry color toners can be applied in subsequent printing stations. Alternately, the toner particles that provide the tactile effect can be applied at the last printing station, or at an intermediate printing station.

Certain embodiments of the invention where multiple color toner images are printed along with the tactile images from the toner particles of this invention can be achieved using a printing machine that incorporates at least five printing stations or printing units. For example, the printing method can comprise forming cyan (C), yellow (Y), magenta (M), and black (K) toner images, and the toner image that provides the tactile effect (T), on the receiver material using at least five sequential toner stations in a color electrophotographic printing machine. These applications of C, Y, M, K, and T toner particles and toner images can be carried out in various orders or sequences. Typically, the T toner particles are applied either before or after the CYMK toner particles (i.e., T-CYMK or CYMK-T). In another exemplary embodiment the CYM toner particles are applied to the receiver material in sequence, followed by application of the T toner, and then followed by the K toner particles (i.e., CYM-T-K).

While the illustrated embodiments refer to a printer 100 (FIG. 1) comprising five printing modules 31, 32, 33, 34, 35 (FIG. 1) arranged in tandem (sequence), in alternate embodiments a printing machine can be used that includes more or less than five printing stations to provide a toner image on the receiver material with more or less than five different toner images. Useful printing machines also include other electrophotographic writers or printer apparatus.

The following examples are provided to illustrate the practice of this invention and are not meant to be limiting in any manner.

A series of exemplary colorless toner formulations were fabricated. For each formulation, a mixture of toner particle ingredients were dry blended as a powder in a 40 liter Henschel mixer for 60 seconds at 1000 RPM to produce a homogeneous blend. A bisphenol-A based polyester from Reichhold Chemicals Corporation, commercially available as Atlac 382ES, was used as the polymeric binder that was dry blended with 2 pph of Orient Chemicals Bontron E-84 charge control agent. In some inventive toner compositions, certain additives were added to the dry blend mixture prior to the extrusion to produce toner particles that provide different coefficients of friction. For example, when low surface energy additives are incorporated into the toner composition, they help reduce the coefficient of friction of the fused toner image. On the other hand, when additives having a rubber phase are incorporated into the toner composition, they help increase the coefficient of friction of the fused toner image.

Each powder dry blend was then melt compounded (extruded) in a twin screw co-rotating extruder to melt the dry blend and to uniformly disperse any optional toner additives including colorants, non-conductive metal oxide particles, charge control agents and waxes. Melt compounding was done at a temperature of 110° C. at the extruder inlet, 110° C. increasing to 196° C. in the extruder compounding zones, and 196° C. at the extruder die outlet. The processing conditions were a dry blend feed rate of 10 kg/hr and an extruder screw speed of 490 RPM. The cooled extrudate was then chopped to approximately 0.3 cm size granules.

After melt compounding, these granules were then fine ground in an air jet mill to the desired toner particle sizes. The toner particle size distribution was measured with a Coulter Counter Multisizer and reported as medium volume weighted diameter ($D_{vol}$). The fine ground toner particles were then classified in a centrifugal air classifier to remove very small toner particles and toner fines that were not desired in the finished product. After this classification, the toner had a particle size distribution with a width, expressed as the diameter at the 50% percentile/diameter at the 16% percentile of the cumulative particle number versus particle diameter, of 1.30 to 1.35.

The resulting mixtures pulverized to yield two toner particles of sizes about 14 μm and about 21 μm mean volume weighted diameter ($D_{vol}$). The toner particles were then surface treated with fumed silica particles, a hydrophobic silica (T810G, manufactured by Cabot Corporation) and large hydrophobic silica particles (Aerosil® NY50, manufactured by Nippon Aerosil) were used. For this surface treatment 2000 grams of toner were mixed with 0.3 weight % of TG810G or 1% of NY50 to give a product containing different weight % of each silica particles. The toner particles and silica particles were mixed in a 10 liter Henschel mixer with a 4 element impeller for 2 minutes at 2000 RPM. Careful attention was paid to ensure that the larger toner particles did not create fines by breaking up during the surface treatment process owing to their large mass. A 21 μm toner particle has nearly 20 times the mass of an 8 μm particle while a 28 μm particle is almost 42 times heavier. It is thus important that care is taken during the materials handing step, so that generation of fine or smaller particles is minimized.

The silica surface treated toner particles were sieved through a 230 mesh vibratory sieve to remove non-dispersed silica agglomerates and any toner flakes that may have formed.

Dry electrophotographic two-component developers were prepared by mixing toner particles having the additives described in Table I with carrier particles. These two-component developers were made at a concentration of 10 weight % toner particles, and 90 weight % carrier particles. The carrier particles were hard magnetic ferrite carrier particles coated with mixture of poly(vinylidene fluoride) and poly(methyl methacrylate). Comparative samples C1-C3 represent images produced using a colorless toner composition as described above with no additives, where the toner mass lay-down was varied to adjust the pile height of the toner. (The fused toner stack height for the 0.5 mg/cm$^2$ lay-down was about 5 μm; the fused toner stack height for the 1.0 mg/cm$^2$ lay-down was about 10 μm; and the fused toner stack height for the 2.0 mg/cm$^2$ lay-down was about 20 μm.) Examples E1-E7 represent various combinations of toner additives and receiver media characteristics in accordance with embodiments of the present invention. Comparative samples C1-C3 and examples E1-E5 were printed using a convention coated media (Sterling Ultra Gloss 118g coated paper). Examples E6-E7 were printed on a specialized media having a rubberized surface coating (Curious Touch paper manufactured by Thibierge & Comar and distributed by Arjowiggins Creative Papers).

TABLE I

Dynamic Coefficient of Friction (COF) for Exemplary Samples

| Sample | Toner Additive | Receiver Media† | Toner Mass (mg/cm$^2$) | $COF_T$ ($\mu_k$) Fused Toner Area | $COF_R$ ($\mu_k$) Receiver Media | Tactile Feel* |
|---|---|---|---|---|---|---|
| C1 | None | M1 | 0.5 | 0.35 | 0.40 | U |
| C2 | None | M1 | 1.0 | 0.35 | 0.40 | U |
| C3 | None | M1 | 2.0 | 0.35 | 0.40 | L |
| E1 | 5% Polywax 500 | M1 | 2.0 | 0.29 | 0.40 | S |
| E2 | 10% WE-3 | M1 | 2.0 | 0.28 | 0.40 | S |
| E3 | 8% Viscol 550 | M1 | 2.0 | 0.24 | 0.40 | S |
| E4 | 5% Kraton G1652 | M1 | 2.0 | 0.44 | 0.40 | L |
| E5 | 5% Elvax 450 | M1 | 2.0 | 0.52 | 0.40 | S |
| E6 | None | M2 | 2.0 | 0.35 | 1.0 | V |
| E7 | 5% Kraton G1652 | M2 | 2.0 | 0.44 | 1.0 | V |

†Receiver media: M1 = Sterling Ulta Gloss 118 g coated paper, M2 = Curious Touch paper
*Tactile Feel: U = unsatisfactory, L = limited, S = satisfactory, V = very good The two-component developers were used in separate experiments in a NexPress™ 3000 printer equipped with 5 electrophotographic modules. The two-component developers were loaded into the 5$^{th}$ module following the CYMK color toner modules. Various toner images were prepared on sheets of paper (receiver media) using the fabricated toner particles to provide a tactile effect.

For each configuration, the dynamic coefficient of friction (COF) was measured against a steel block at 23° C. under dry conditions. The COF of the receiver medium was measured in an unprinted region of the receiver medium. The COF of the fused toner area was measured in a large uniform patch of fused toner having the indicated toner mass lay-down.

The resulting printed images were subjectively evaluated by running the fingertips across the surface of the receiver media containing the tactile image. The results of the subjective evaluation of tactile differentiation are summarized in the last column of Table I. It was found that when the mass lay-down of conventional toner was 0.5 or 1.0 mg/cm2, the resulting pile height of the fused toner was not sufficiently high to provide any discernible tactile difference. When the pile height was increased by increasing the mass lay-down of toner to 2 mg/cm$^2$ or more, a small tactile difference could be felt. This limited tactile effect is not large enough to provide satisfactory performance for many applications.

Figure 5:
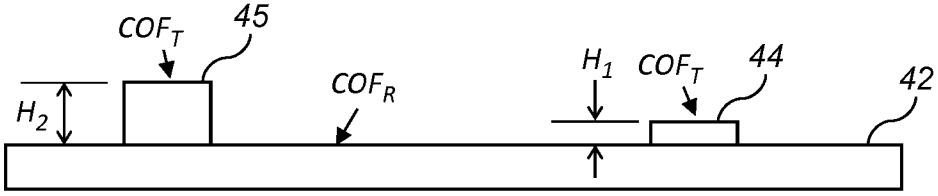
FIG. 5 illustrates a tactile toner feature printed on a piece of receiver media.

FIG. 5 illustrates a receiver media 42 with a toner feature 44 having a shorter toner stack height (e.g., $H_1$=5 μm) that doesn't provide a significant tactile effect and a tactile toner feature 45 having a higher toner stack height (e.g., $H_2$=20 μm) that is high enough to provide a detectable tactile effect. The area of the printed image corresponding to the toner feature 44 and the tactile toner feature 45 has a toner coefficient of friction $COF_T$, and the receiver media 42 has a receiver media coefficient of friction $COF_R$. For the conventional toner and the receiver medium M1 used in comparative samples C1-C3, the coefficient of friction difference between the toner and the receiver medium was found to be:

$$\Delta COF=|COF_R-COF_T|=|0.40-0.35|=0.05$$

where $COF_T$ is the toner coefficient of friction and $COF_R$ is the receiver media coefficient of friction.

When toner additives are used to increase the coefficient of friction difference between the fused toner and receiver media, the resulting tactile difference is further enhanced. For all of the tested samples where the coefficient of friction difference (ΔCOF) between the fused toner and receiver media was greater than 0.05 (i.e., coefficient of friction difference was ΔCOF≥0.06), the magnitude of the tactile feel was noticeably increased. For all of the tested samples where the coefficient of friction difference was ΔCOF≥0.11, the level of tactile differentiation was found to be satisfactory. For all of the tested samples where the coefficient of friction difference was ΔCOF≥0.20, the level of tactile differentiation was found to be very good.

It can be seen that the coefficient of friction of the fused toner can be controlled by incorporating appropriate additives. When low surface energy additives such as polyethylene (Polywax 500), or polypropylene (Viscol 550) or ester waxes (WE-3 from Nippon Oil and Fine Chemicals) were added to the toner composition, the resulting coefficient of friction values were lowered as shown in Table I. On the other hand, when rubber phase additives (Kraton G1652 and Elvax 450) were added to the toner composition, the resulting coefficient of friction of the fused image was increased.

It was found that absolute coefficient of friction difference (ΔCOF) is the most important factor with enhanced tactile feel. It did not matter whether the fused toner or the receiver media has the higher coefficient of friction value. As long as a sufficient level of difference in the coefficient of friction exists between the two surfaces, a satisfactory level of tactile feel can be achieved. Samples E4-E5 represent examples where the coefficient of friction of the fused toner area was larger than that of the receiver media. For sample E4, the coefficient of friction difference of ΔCOF=0.04 provided only a limited tactile feel, whereas for sample E5 the coefficient of friction difference of ΔCOF=0.12 provided a satisfactory tactile feel.

It was also found that the enhanced coefficient of friction difference (i.e., ΔCOF≥0.06) could be provided by adjusting the toner composition (as in samples E1-E3, E5) or by adjusting the characteristics of the receiver media (as in samples E6-E7). For samples E6-E7, the selected receiver media had a high coefficient of friction ($COF_R$=1.00), which provided a large coefficient of friction difference that was found to provide a very good tactile feel, even for the case where a conventional toner was used without any special additives (see sample E6).

Figure 6:
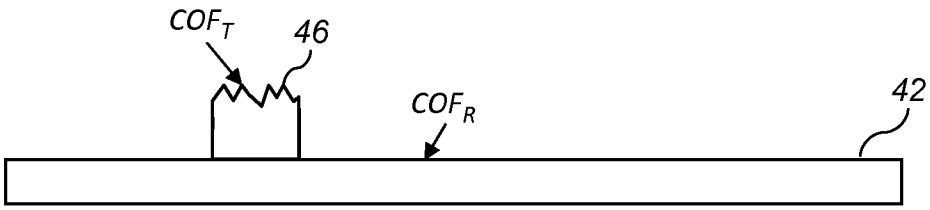
FIG. 6 illustrates a tactile toner feature having a rough surface printed on a piece of receiver media.

In the example illustrated in FIG. 5, the tactile toner feature 45 is shown as having a smooth top surface. In this case, the toner coefficient of friction is controlled by the chemical composition of the toner components. FIG. 6 illustrates another example where a tactile toner feature 46 is printed onto the receiver media 42. In this case, the tactile toner feature 46 has a rough surface that contributes to increasing the toner coefficient of friction $COF_T$. In some embodiments, the surface roughness of the tactile toner features 46 can be controlled by choosing appropriate toner additives (e.g., abrasive materials such as clay, calcium carbonate or alumina). In some embodiments, the fusing process can also be controlled to adjust the surface roughness of the tactile toner features 46.

The present invention has the advantage that the tactile feel of the tactile features can be increased by controlling the coefficient of friction of one or both of the toner or the receiver medium without increasing the toner stack height. This mitigates many of the problems that are associated with creating large stack heights (e.g., H>20 μm), such as the difficulties in reliably developing and fusing tall toner stacks. This enables tactile features to be formed on a printed image that can be used to convey information to a visually impaired person. The tactile features can include Braille characters, as well as other forms of textures and patterns that can be sensed to convey information to the visually impaired person.

While the above-described embodiment relates to a tactile printed image where the marking particles are printed on the receiver medium using an electrographic printing process, one skilled in the art will recognize that the invention can also be applied to images printed using other printing technologies as well. For example, in alternate embodiments the marking particles used to form the tactile features can be deposited using an inkjet printing process or a printing press (e.g., an offset printing press or a gravure printing press). For cases where the tactile printed image includes both a visible image and a pattern of tactile features, the printing process used to print the tactile features may or may not be the same as the printing process used to print the visible image. For example, the tactile features can be printed using an electrographic printing process, while the visible image can be printed using an inkjet printing process.

The invention has been described in detail with particular reference to certain preferred embodiments thereof, but it will be understood that variations, combinations, and modifications can be effected by a person of ordinary skill in the art within the spirit and scope of the invention.

PARTS LIST

31 printing module
32 printing module
33 printing module
34 printing module
35 printing module
38 print image
39 fused image
40 supply unit
42 receiver
42*a* receiver
42*b* receiver
42*c* receiver
42*d* receiver
44 toner feature
45 tactile toner feature
46 tactile toner feature
50 transfer subsystem
60 fuser module
62 fusing roller
64 pressure roller
66 fusing nip
68 release fluid application substation
69 output tray
70 finisher
81 transport web
86 cleaning station
99 logic and control unit (LCU)
100 printer
102 roller
103 roller
104 transmission densitometer
105 power supply
109 inter-frame area

110 light beam
111 imaging member
112 intermediate transfer member
113 transfer backup member
121 imaging member
122 intermediate transfer member
123 transfer backup member
124 corona tack-down charger
125 corona tack-down charger
131 imaging member
132 intermediate transfer member
133 transfer backup member
141 imaging member
142 intermediate transfer member
143 transfer backup member
151 imaging member
152 intermediate transfer member
153 transfer backup member
201 first transfer nip
202 second transfer nip
206 photoreceptor
210 charging subsystem
211 meter
212 meter
213 grid
216 surface
220 exposure subsystem
225 development subsystem
226 toning shell
227 magnetic core
240 power source
300 input pixel data
305 workflow inputs
310 image processing path
315 output pixel data
320 screening unit
325 screened pixel data
330 print engine
335 print image data
340 tactile processing path
345 tactile pixel data
$COF_T$ toner coefficient of friction
$COF_R$ receiver media coefficient of friction
ΔCOF coefficient of friction difference
H toner stack height
ITM1-ITM5 intermediate transfer member
PC1-PC5 imaging member
$R_n$-$R_{(n-6)}$ receiver
TR1-TR5 transfer backup member

The invention claimed is:

1. A method for forming a tactile printed image on a receiver medium to convey information to a visually-impaired person, comprising:

receiving tactile image data having an array of image pixels with tactile pixel values, the tactile image data defining a pattern of tactile features; and forming the tactile printed image by depositing tactile marking material onto the receiver medium to provide the pattern of tactile features, wherein no tactile marking material is deposited onto portions of the receiver medium where the corresponding tactile pixel values indicate that no tactile features are to be formed, and wherein tactile marking material is deposited onto portions of the receiver medium where the corresponding tactile pixel values indicate that tactile features are to be formed;

wherein the receiver medium has a first coefficient of friction and the formed tactile features corresponding to the portions of the tactile printed image having deposited tactile marking material have a second coefficient of friction which differs from the first coefficient of friction by at least 0.20, and wherein the formed tactile features corresponding to the portions of the tactile printed image having deposited tactile marking material are raised by at least 20 microns relative to the surface of the receiver medium.

2. The method of claim 1 wherein the receiver medium has a lower coefficient of friction than the portions of the tactile printed image having deposited tactile marking material.

3. The method of claim 1 wherein the receiver medium has a higher coefficient of friction than the portions of the tactile printed image having deposited tactile marking material.

4. The method of claim 1 wherein the tactile marking material is substantially colorless so that the tactile printed image has an optical density of no more than 0.2.

5. The method of claim 1 wherein the tactile marking material includes a visible colorant so that the tactile printed image has an optical density is more than 0.2.

6. The method of claim 1 wherein the tactile marking material is deposited using an electrographic printing process.

7. The method of claim 1 wherein the tactile marking material is deposited using an inkjet printing process.

8. The method of claim 1 wherein the tactile marking material is deposited using a printing press.

9. The method of claim 1 wherein the tactile image data includes representations of one or more Braille characters.

10. The method of claim 1 wherein the tactile image data includes one or more image regions containing texture patterns.

11. The method of claim 1 wherein the tactile pixel values are binary pixel values having either a first state indicating that no tactile feature is to be formed or a second state indicating that a tactile feature is to be formed.

12. The method of claim 1 further including depositing one or more colored marking materials onto the receiver medium to form a color printed image in registration with the tactile printed image.

13. The method of claim 12 wherein the one or more colored marking materials include a cyan marking material, a magenta marking material, a yellow marking material or a black marking material.

14. A method for forming a tactile printed image on a receiver medium to convey information to a visually-impaired person, comprising:

receiving tactile image data having an array of image pixels with tactile pixel values, the tactile image data defining a pattern of tactile features; and forming the tactile printed image by depositing tactile marking material onto the receiver medium, wherein no tactile marking material is deposited onto portions of the receiver medium where the corresponding tactile pixel values indicate that no tactile features are to be formed, and wherein tactile marking material is deposited onto portions of the receiver medium where the corresponding tactile pixel values indicate that tactile features are to be formed;

wherein the receiver medium has a first coefficient of friction and the portions of the tactile printed image having deposited tactile marking material have a second coefficient of friction which differs from the first coefficient of friction by at least 0.06, and wherein the portions of the tactile printed image having deposited tactile marking material are raised by at least 20 microns relative to the surface of the receiver medium;

wherein the deposited tactile marking material includes an additive that alters the coefficient of friction of the portions of the tactile printed image having the deposited tactile marking material relative to portions of a printed image having a deposited marking material with an identical formulation except that it does not include the additive.

15. The method of claim 14 wherein the additive is an abrasive material that increases the coefficient of friction of the portions of the tactile printed image having the deposited tactile marking material.

16. The method of claim 14 wherein the additive is a material that decreases the coefficient of friction of the portions of the tactile printed image having the deposited tactile marking material by providing a reduced surface energy.

* * * * *